US005884355A

United States Patent [19]

De Guzman

[11] Patent Number: 5,884,355

[45] Date of Patent: Mar. 23, 1999

[54] MOP ELEMENT FOR USE IN CLEAN ROOM MOP

[75] Inventor: Joselito De Guzman, Redondo Beach, Calif.

[73] Assignee: Micronova Manufacturing, Inc., Torrance, Calif.

[21] Appl. No.: 767,131

[22] Filed: Dec. 19, 1996

[51] Int. Cl.[6] ..... A47L 13/20

[52] U.S. Cl. ..... 15/229.2; 15/228; 15/229.1

[58] Field of Search ..... 15/151, 210.1, 15/228, 229.1, 229.2, 229.3, 229.4, 229.5, 229.6, 229.7, 229.8, 229.9

[56] References Cited

U.S. PATENT DOCUMENTS

| | | | |
|---|---|---|---|
| 84,129 | 11/1868 | Mason | 15/229.2 |
| 2,233,289 | 2/1941 | Hatzenbuehler | 15/229.1 |
| 2,300,821 | 11/1942 | Weaver | 15/229.1 |
| 3,696,460 | 10/1972 | Moss | 15/229.1 |
| 4,114,224 | 9/1978 | Disko | 15/229.1 |
| 4,288,884 | 9/1981 | Bahls | 15/229.2 |
| 4,313,774 | 2/1982 | Arthur | 15/229.1 |
| 4,523,347 | 6/1985 | Tames | 15/228 |
| 4,564,969 | 1/1986 | Heinonen | 15/228 |
| 4,675,932 | 6/1987 | Hofacker, Jr. | 15/229.2 |
| 4,717,616 | 1/1988 | Harmon | 15/229.1 |
| 4,750,234 | 6/1988 | Quearry | 15/229.1 |
| 4,951,341 | 8/1990 | Shears | 15/228 |
| 4,995,133 | 2/1991 | Newell | 15/228 |
| 5,027,468 | 7/1991 | Leventhal | 15/229.3 |
| 5,638,569 | 6/1997 | Newell | 15/228 |

FOREIGN PATENT DOCUMENTS

| | | | |
|---|---|---|---|
| 2003725 | 3/1979 | United Kingdom | 15/229.1 |

OTHER PUBLICATIONS

Perfoclean; The Ultimate in routine cleaning of general areas in cleanrooms; VerHoog PSI Holland b.v.; Kleine Tocht 3, 1507 CB Zaandam/ Holland; It is applicant's present understanding that this reference was distributed in 1991.

*Primary Examiner*—Randall E. Chin
*Attorney, Agent, or Firm*—Henricks, Slavin & Holmes LLP

[57] ABSTRACT

A cleaning element including a base portion and a plurality of cleaning members, each defining a first surface, a second surface, a first edge between the first surface and the second surface extending from the base portion to the free end, and a second edge between the first surface and the second surface extending from the base portion to the free end. At least one of the first and second edges is substantially non-linear.

28 Claims, 3 Drawing Sheets

MOP ELEMENT FOR USE IN CLEAN ROOM MOP

BACKGROUND OF THE INVENTION

1. Field of Invention

The present invention relates generally to mops and, more particularly, for example, to mops which are adapted to be used in dust and lint-free environments such as clean rooms.

2. Description of the Related Art

Clean rooms are rooms in which dust and other small particles are filtered from the air and in which low or non-linting clothing is worn to avoid contaminating such things as pharmaceuticals and electronic components and other delicate, sensitive equipment. The number of clean rooms has steadily increased in recent years due to the rapid growth in industries, such as the semi-conductor fabrication industry, which require clean rooms for manufacture and testing. As would be the case in any other facility, clean room floors must be periodically mopped. Mopping a clean room floor, however, presents a number of unique challenges. For example, the mop cannot itself produce lint, which is the case with ordinary string mops because the strings are made of cotton or other linting material. It is also important that the mop pick up very small dirt and dust particles.

One type of mop that is used in clean rooms includes string-like cleaning members formed from sheets of material having relatively long parallel strands or fibers, such as polyvinylalcohol ("PVA"). The long parallel fibers form capillaries or passageways which absorb cleaning solution and other liquids. Referring to FIG. 1, PVA cleaning element 10 includes a plurality of string-like cleaning members 12 and a base portion 14. The base portion and cleaning members are formed by cutting slits 16 into a sheet of PVA. A mop head is assembled by stacking a number of sheets (typically 10 to 15) one on top of the other and sewing them together. The mop head is folded along fold line 18 around an attachment rod on a bracket that secures the mop head to the mop. The cleaning members 12 will dangle from the attachment rod in a manner similar to the strings in a common string mop.

Mops having cleaning elements formed from materials such as PVA are an improvement over common string mops because they do not produce lint. However, the inventor herein has determined that there are a number of aspects of the mops of this type presently known in the art which may be improved. For example, the cleaning elements may tear at the intersection between the string-like cleaning members and at the free end of the cleaning members. Also, the manner in which the mop head is attached to the mop may be improved. The bracket having the attachment rod about which the mop head is folded, which is typically made of metal, defines the lateral edges of the mop. As a result, the bracket may scratch floors and other surfaces during cleaning. With respect to performance, the fibrous material on the top and bottom surfaces of PVA sheets (as well as sheets of similar materials) tends to absorb less liquid than the material beneath the surface. This may reduce the potential efficiency of the mop head.

OBJECT AND SUMMARY OF THE INVENTION

A general object of the present invention is to provide a cleaning element, such as that which may be used in a mop head, having string or strip-like cleaning members formed from PVA or other materials having relatively long parallel fibers or channels which minimizes the possibilities of tearing or linting described above and which has superior cleaning properties to those presently known in the art.

In particular, one object of the present invention is to provide a cleaning element that is less likely to tear than presently known cleaning elements. Another object of the present invention is to provide a cleaning element that is more absorbent than those presently known in the art. A further object of the present invention is to provide a mop that is less likely to scratch floors and other surfaces.

In order to accomplish some of these as well as other objectives, a cleaning element in accordance with one embodiment of the present invention includes a base portion, a plurality of cleaning members extending from the base portion, and at least one aperture formed in the base member and abutting two adjacent cleaning members. The aperture substantially reduces the tendency of the base portion to tear. A cleaning element in accordance with another embodiment of the invention includes cleaning members having a curved free end, which minimizes the possibility of this portion of the cleaning element tearing.

In order to accomplish some of these as well as other objectives, a cleaning element in accordance with still another embodiment of the invention includes a base portion and a plurality of cleaning members, each defining a first surface, a second surface, a first edge between the first surface and the second surface extending from the base portion to the free end, and a second edge between the first surface and the second surface extending from the base portion to the free end. At least one of the first and second edges is substantially non-linear.

There are a number of advantages associated with a cleaning member having a non-linear edge. For example, as compared to a cleaning member of a given length with a linear edge, the non-linear edge increases the exposed area of the more absorbent material beneath the surface of a PVA sheet. This increases the total amount of liquid that is absorbed during normal use and also increases the rate at which liquid and particles are absorbed and released. The non-linear edge of the cleaning member also focuses the force applied to the cleaning element onto a smaller area than would a linear edge, thereby increasing the contact pressure and improving cleaning performance. In addition, many of the linear fibers or internal strands adjacent to the non-linear edge are severed. As a result, the present cleaning members are more longitudinally flexible than those with straight edges.

In order to accomplish some of these as well as other objectives, a cleaning element in accordance with another embodiment of the invention includes a base portion defining first and second side edges and first and second lateral edges, a plurality of cleaning members extending from the first side edge, a plurality of cleaning members extending from the second side edge, and a bracket indentation formed in at least one of the first and second lateral edges of the base portion. So configured, the lateral edges of base portion will extend beyond the bracket that secures the mop head to the mop, thereby minimizing the possibility of the bracket scratching floors and other surfaces.

In order to accomplish some of these as well as other objectives, a cleaning element in accordance with another embodiment of the invention includes a cleaning member having at least one aperture. The aperture increases the exposure of the more absorbent material beneath the surface of a PVA sheet, thereby increasing the volume of liquid absorbed as well as also increase the rate at which liquid and particles are absorbed and released. The aperture also traps small particles during wiping.

Many other features and attendant advantages of the present invention will become apparent as the invention becomes better understood by reference to the following detailed description considered in conjunction with the accompanying drawings.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined solely by the appended claims.

Figures 1, 2:
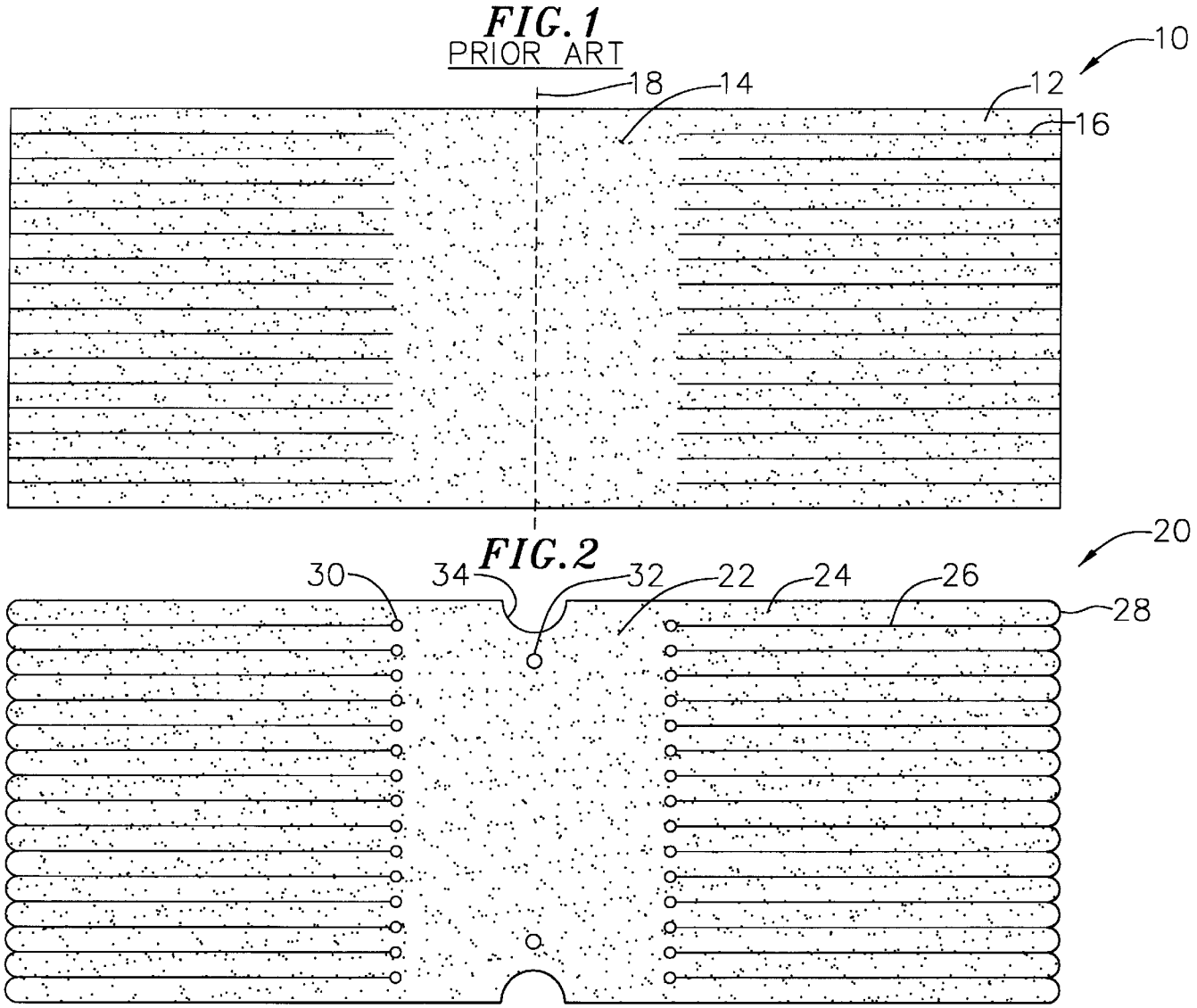
FIG. 1 PRIOR ART
FIG. 1 is a plan view of a conventional cleaning element.
FIG. 2 is a plan view of a cleaning element in accordance with one embodiment of the present invention.

As illustrated for example in FIG. 2, a cleaning element 20 in accordance with one embodiment of the present invention includes a base portion 22 having a plurality of cleaning members 24 extending from the lateral edges of the base portion. The cleaning members 24 are formed by cutting slits 26 into a sheet of material, such as PVA. The free longitudinal ends 28 of the cleaning members 24 are curved, which minimizes tearing. The base portion 22 preferably includes a series of round apertures 30 where the slits 26 meet the base portion and abut adjacent cleaning members. The apertures 30 reduce the tendency of the base portion to tear.

As shown by way of example in FIG. 2, cleaning element 20 may include a pair of assembly apertures 32 that may be used when a plurality of the cleaning members are secured to one another to form a mop head. [See the discussion below with respect to FIG. 5.] Alternatively, stitching across the base portion may be used to form the mop head. Each of the lateral edges of the base portion include an indentation 34. Once a plurality of cleaning elements are assembled into a mop head, the indentations, which are preferably semicircular, provide a space for the bracket which secures the mop head to the mop. The indentations should be dimensioned such that the lateral edges of the base portion 22 extend laterally sufficiently beyond the bracket so as to reduce the likelihood that the bracket will scratch floors and other surfaces.

Figure 3:
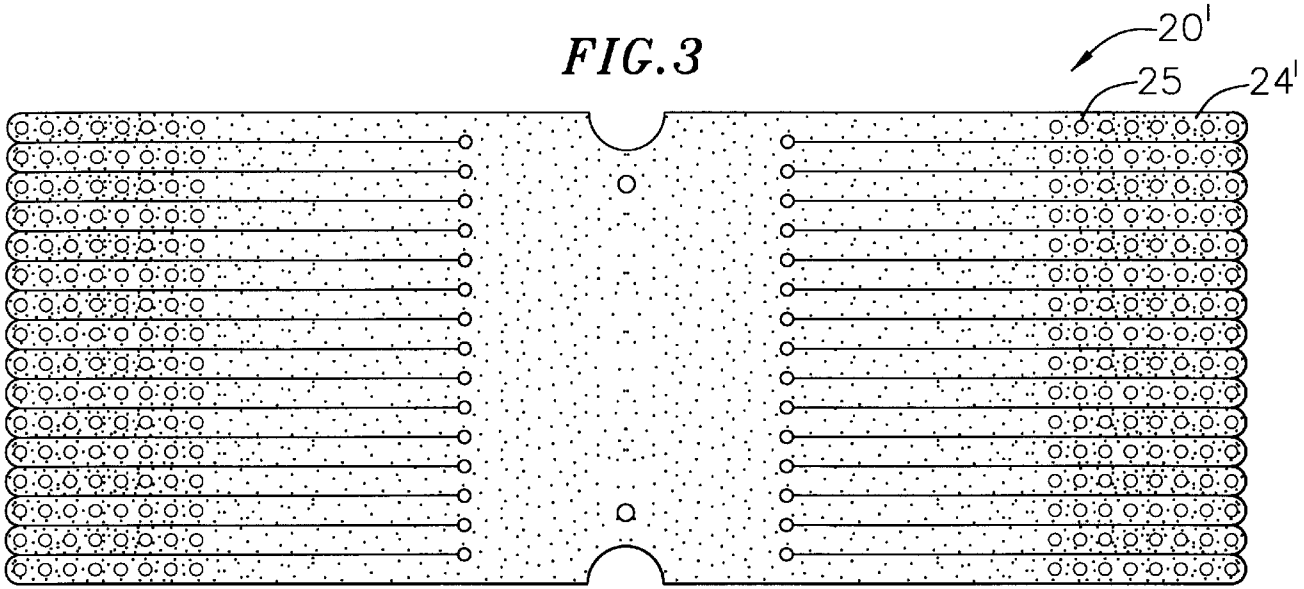
FIG. 3 is a plan view of a cleaning element in accordance with another embodiment of the present invention.

The exemplary embodiment shown in FIG. 2 may be modified in the manner illustrated, for example, in FIG. 3. More specifically, cleaning element 20' includes a plurality of apertures 25 near the free end of the cleaning members 24'. The apertures perform a number of advantageous functions. For example, the apertures increase the exposed area of the absorbent material beneath the surface of a PVA sheet and trap small particles. Formation of the apertures also severs some of the longitudinally extending fibers or passageways, which in turn increases the flexibility of the cleaning member.

Figure 4:
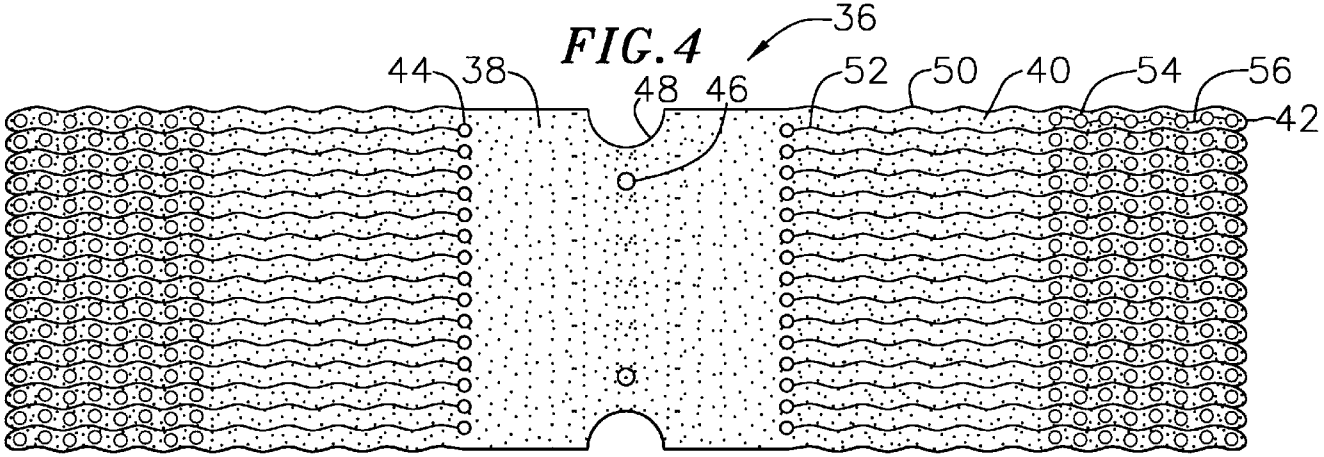
FIG. 4 is a plan view of a cleaning element in accordance with still another embodiment of the present invention.

Referring to FIG. 4, a cleaning element 36 in accordance with another embodiment of the present invention includes a base portion 38, a plurality of cleaning members 40 having curved free ends 42, tear resistant apertures 44, assembly apertures 46 and indentations 48. These aspects of the cleaning element perform the same functions and provide the same benefits as the related elements described above with respect to FIG. 2.

Additionally, the edges 50 of the cleaning members in the embodiment shown in FIG. 4 are non-linear and preferably define a corrugated shape. There are a number of advantages associated with this aspect of the invention. For example, the non-linear edge increases the exposed area of the absorbent material beneath the surface of a PVA sheet and, therefore, increases the total amount of liquid that can be absorbed during normal use as well as the rate at which liquid and particles are absorbed and released. The non-linear edge also focuses the force applied to the cleaning element onto a relatively small area, thereby increasing contact pressure and improving cleaning performance. In addition, many of the linear fibers adjacent to the edge are severed when the non-linear slits 52 are formed. This results in a cleaning member having greater longitudinal flexibility than those having straight edges.

In accordance with another advantageous aspect of the embodiment shown in FIG. 4, a plurality of apertures 54 are provided near the free end of the cleaning members 40. The apertures, which are preferably arranged along a non-linear path 56, perform the advantageous functions discussed above with reference to FIG. 3. Additionally, formation of the apertures along the non-linear path severs more of the longitudinally extending fibers or passageways, which in turn further increases the flexibility of the cleaning member.

With respect to dimensions, the exemplary cleaning elements shown in FIGS. 2–4 are 32 inches long and 8 inches wide. The cleaning members are 13.5 inches long and 0.5 inch wide, while the radius of the curved free ends is 0.25 inch. The base portion is 5 inches wide and the radius of the indentations in the lateral edges thereof are 0.75 inch. The diameter of the tear resisting apertures in the base portion between adjacent cleaning members is approximately 0.125 inches, as is the diameter of the assembly apertures, which are located 1.3 inches from the lateral edges of the base portion. The apertures in the cleaning elements are approximately 0.18 inches in diameter.

Figure 5:
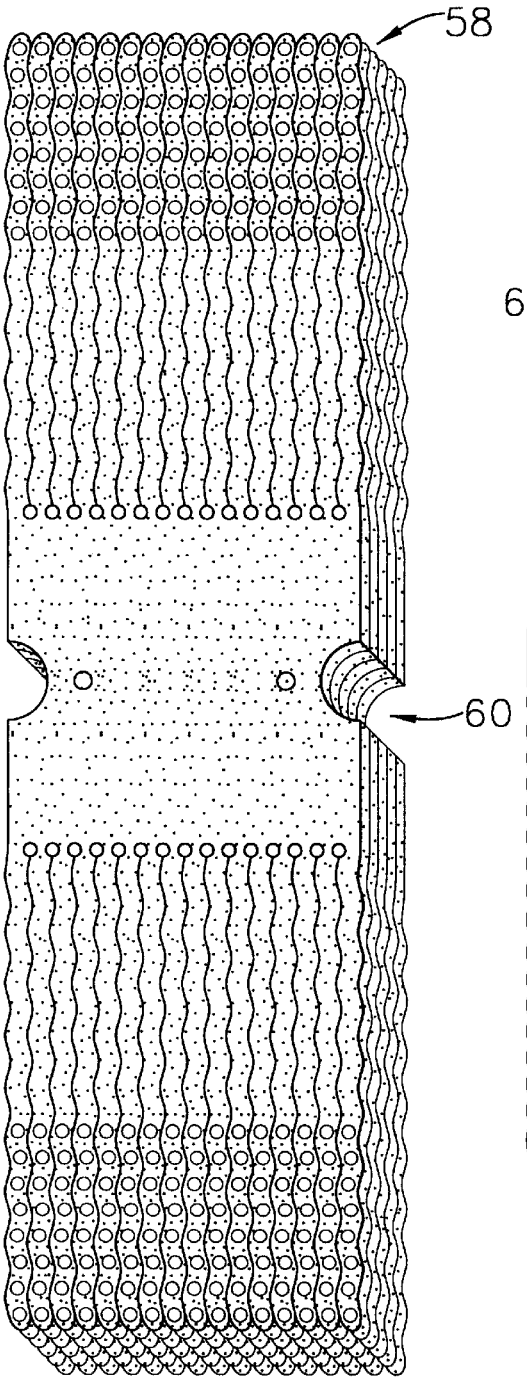
FIG. 5 is a perspective view of a mop head in accordance with the embodiment of the present invention shown in FIG. 4.
Figure 6:
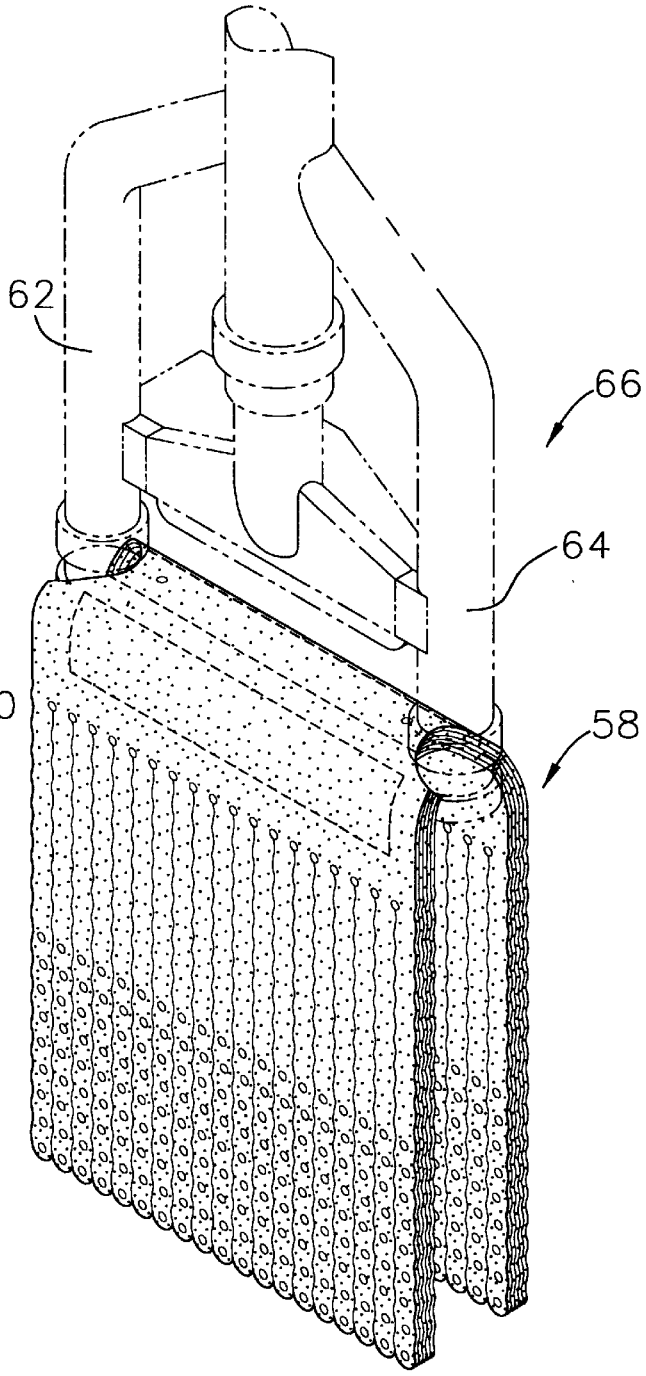
FIG. 6 is a perspective view of a mop including the mop head shown in FIG. 5.

As illustrated for example in FIGS. 5 and 6, a mop head 58 in accordance with the present invention may include a plurality (10 to 15 is a preferable range) of cleaning elements 36 shown in FIG. 4. Alternatively, although not shown, a mop head may be formed from the cleaning elements shown in FIGS. 2 and 3 or from a combination of the cleaning elements shown in FIGS. 2–4. The indentations 48 together form channels 60. As a result, the lateral edges of the mop head will extend beyond the side elements 62 and 64 of the mop handle bracket 66, thereby reducing the likelihood that the side elements will scratch floors and other surfaces.

Although the present invention has been described in terms of the preferred embodiment above, numerous modifications and/or additions to the above-described preferred embodiments would be readily apparent to one skilled in the art. By way of example, but not limitation, the cleaning elements may be formed from synthetic rubbers such as latex. Many or all of the dimensions discussed above may also be modified as needed. It is intended that the scope of the present invention extends to all such modifications and/or additions and that the scope of the present invention is limited solely by the claims set forth below. With respect to the claims, it is applicant's intention that the claims not be interpreted in accordance with the sixth paragraph of 35 U.S.C. § 112 unless the term "means" is used followed by a functional statement.

What is claimed is:

1. A cleaning element, comprising:

a base portion;

a plurality of cleaning members having a first longitudinal end connected to the base portion and a free longitudinal end, each cleaning member defining a first surface, a second surface, a first edge between the first surface and the second surface extending from the base portion to the free end, and a second edge between the first surface and the second surface extending from the base portion to the free end, at least one of the first and second edges of at least one of the cleaning members being substantially non-linear and defining the outermost edge of the cleaning element; and at least one aperture formed in the base portion and abutting two adjacent cleaning members.

2. A cleaning element as claimed in claim 1, wherein both of the first and second edges are substantially non-linear.

3. A cleaning element as claimed in claim 1, wherein at least one of the first and second edges are curved.

4. A cleaning element as claimed in claim 1, wherein the cleaning members comprise a liquid absorbent material having relatively long fibers.

5. A cleaning element as claimed in claim 4, wherein the material comprises polyvinylalcohol.

6. A cleaning element as claimed in claim 1, wherein at least one of the first and second surfaces is substantially flat.

7. A cleaning element as claimed in claim 1, wherein at least one of the first and second surfaces defines a shape having alternating ridges and grooves.

8. A cleaning element as claimed in claim 1, wherein at least one aperture is formed in at least one of the cleaning members, the at least one aperture passing through both of the first and second surfaces.

9. A cleaning element as claimed in claim 8, wherein the at least one aperture comprises a plurality of longitudinally spaced apertures.

10. A cleaning element as claimed in claim 1, wherein the respective free ends of the cleaning members are curved.

11. A cleaning element as claimed in claim 1, wherein the base portion defines first and second side edges facing in substantially opposite directions and respective portions of the plurality of cleaning members extend outwardly from each of the side edges.

12. A cleaning element as claimed in claim 1, wherein the cleaning element defines a first cleaning element, further comprising:

at least a second cleaning element secured to the first cleaning element, thereby defining a mop head.

13. A cleaning element, comprising:

a base portion;

a plurality of cleaning members having a first longitudinal end connected to the base portion and a free longitudinal end, each cleaning member defining a first surface, a second surface, a first edge between the first surface and the second surface extending from the base portion to the free end, and a second edge between the first surface and the second surface extending from the base portion to the free end, at least one of the first and second edges of at least one of the cleaning members being substantially non-linear and defining the outermost edge of the cleaning element; and wherein the base portion defines a side edge adjacent to the cleaning members and first and second lateral edges substantially perpendicular to the side edge, the cleaning element further comprising:

an indentation formed in at least one of the base portion lateral edges.

14. A cleaning element, comprising:

a base portion;

a plurality of cleaning members extending from the base portion, each cleaning member defining a first longitudinal end adjacent to the base portion, a free longitudinal end, and respective side walls wherein each sidewall has a shape; and at least one aperture having a shape defined by an aperture wall formed in the base portion and abutting the respective first longitudinal ends of two adjacent cleaning members and wherein the aperture wall shape is different from the sidewall shapes of the adjacent cleaning members.

15. A cleaning element as claimed in claim 14, wherein the cleaning members comprise a liquid absorbent material having relatively long fibers.

16. A cleaning element as claimed in claim 15, wherein the material comprises polyvinylalcohol.

17. A cleaning element as claimed in claim 14, wherein at least one aperture is formed in at least one of the cleaning members.

18. A cleaning element as claimed in claim 14, wherein the cleaning element defines a first cleaning element, further comprising:

at least a second cleaning element secured to the first cleaning element, thereby defining a mop head.

19. A cleaning element, comprising:

a base portion;

a plurality of cleaning members extending from the base portion, each cleaning member defining a first longitudinal end adjacent to the base portion and a free longitudinal end; and at least one aperture formed in the base portion and abutting two adjacent cleaning members, the at least one aperture defining a substantially curved shape.

20. A cleaning element, comprising:

a base portion;

a plurality of cleaning members extending from the base portion, each cleaning member defining a first longitudinal end adjacent to the base portion, a free longitudinal end, a length extending from the first longitudinal end to the free longitudinal end, and a width extending substantially perpendicularly to the length, the cleaning members being disconnected from one another along the lengths thereof; and at least one aperture formed in at least one of the cleaning members, the at least one aperture defining a width substantially greater than 10% of the width of the cleaning member.

21. A cleaning element as claimed in claim 20, wherein the at least one aperture comprises a plurality of apertures.

22. A cleaning element as claimed in claim 20, wherein the at least one aperture is substantially adjacent to the free longitudinal end.

23. A cleaning element as claimed in claim 20, wherein the cleaning element defines a first cleaning element, further comprising:

at least a second cleaning element secured to the first cleaning element, thereby defining a mop head.

24. A cleaning element, comprising:

a base portion;

a plurality of cleaning members extending from the base portion, each cleaning member defining a first longitudinal end adjacent to the base portion, a free longitudinal end, a length extending from the first longitudinal end to the free longitudinal end, and a width extending substantially perpendicularly to the length; and a plurality of apertures formed in at least one of the cleaning members and spaced along a non-linear path, the apertures defining a width substantially greater than 10% of the width of the cleaning member.

25. A cleaning element, comprising:

a base portion defining first and second side edges and first and second lateral edges, the first and second lateral edges defining respective heights;

a plurality of cleaning members extending from the first side edge of the base portion and a plurality of cleaning members extending from the second side edge of the base portion, each cleaning member defining a first longitudinal end adjacent to the base portion and a free longitudinal end; and a bracket indentation formed in at least one of the first and second lateral edges of the base portion, extending substantially the entire height thereof and extending inwardly into the base portion.

26. At A cleaning element as claimed in claim 25, wherein a bracket indentation is formed in each of the first and second lateral edges of the base portion.

27. A cleaning element as claimed in claim 25, wherein the cleaning element defines a first cleaning element, further comprising:

at least a second cleaning element secured to the first cleaning element, thereby defining a mop head.

28. A cleaning element, comprising:

a base portion defining first and second side edges and first and second lateral edges;

a plurality of cleaning members extending from the first side edge of the base portion and a plurality of cleaning members extending from the second side edge of the base portion, each cleaning member defining a first longitudinal end adjacent to the base portion and a free longitudinal end; and a bracket indentation formed in at least one of the first and second lateral edges of the base portion and extending inwardly into the base portion, the bracket indentation defining a substantially curved shape.

* * * * *